US011124939B2

(12) United States Patent
Gregory et al.

(10) Patent No.: US 11,124,939 B2
(45) Date of Patent: Sep. 21, 2021

(54) PILE LIFTING APPARATUS AND METHOD

(71) Applicant: Gregory Enterprises, Incorporated, Ada, OK (US)

(72) Inventors: Steven D. Gregory, Ada, OK (US); Eddie Hogue, Centrahoma, OK (US); Joshua Dustin Johnson, Ada, OK (US); Christopher Logan, Stonewall, OK (US); Allen Musser, Ada, OK (US); Richard Sykes, Bahama, NC (US)

(73) Assignee: Gregory Enterprises, Incorporated, Ada, OK (US)

( * ) Notice: Subject to any disclaimer, the term of this patent is extended or adjusted under 35 U.S.C. 154(b) by 911 days.

(21) Appl. No.: 13/945,119

(22) Filed: Jul. 18, 2013

(65) Prior Publication Data

US 2015/0021529 A1 Jan. 22, 2015

(51) Int. Cl.
*E21B 19/00* (2006.01)
*E02D 11/00* (2006.01)

(52) U.S. Cl.
CPC ..... *E02D 11/00* (2013.01)

(58) Field of Classification Search
CPC ..... E02D 11/00; B66F 11/00; B66F 15/00; B66F 19/00; B66F 2700/00
USPC ..... 254/29 R, 30, 32, 228, 30.13, 131.5
See application file for complete search history.

(56) References Cited

U.S. PATENT DOCUMENTS 1,153,024 A * 9/1915 Brown ..... B66C 1/48 294/104
6,468,002 B1 10/2002 Gregory et al.
7,137,616 B2 * 11/2006 Kysely ..... E04H 17/265 254/30
7,431,266 B1 * 10/2008 Evans ..... E04H 17/265 254/30

* cited by examiner

*Primary Examiner* — Orlando E Aviles
*Assistant Examiner* — Sarah Akyaa Fordjour
(74) *Attorney, Agent, or Firm* — McAfee & Taft

(57) ABSTRACT

An apparatus for lifting and supporting a pile is provided. The apparatus includes a support structure coupled to the pile and a lifting device coupled to the support structure. Gripping plates of a lift head engage and lift the pile during extension of the lifting device. During retraction of the lifting device, gripping plates of a gravity vice engage the pile to support the pile in the lifted position. The extension and retraction of the lifting device is alternately repeated to lift the pile in steps to a desired height.

19 Claims, 5 Drawing Sheets

PILE LIFTING APPARATUS AND METHOD

TECHNICAL FIELD

The disclosure relates generally to foundation construction and repair and, more particularly, to an apparatus and method for lifting a foundation pile.

BACKGROUND

Buildings, including houses, office buildings, strip malls and the like, are often constructed such that a building frame rests on a foundation. Foundation types are generally known and can include concrete slabs, reinforced concrete slabs, pile-and-beam, footings, and other types. Sometimes foundations include structures that are deep enough to contact, or tie into, solid strata such as bedrock. Pile—and beam foundation structures may include a set of piers upon which a building structure rests. In a typical configuration, portions of the building structure, such as floor joists and/or sill plates rest on the piles. The piles are preferably in contact with bedrock to provide a relatively fixed support structure. However, sometimes piles are not driven completely to bedrock.

Changing soil conditions, improper building construction, effects of nature and the like can result in portions of the building sagging or drooping. The sagging and drooping can, in turn damage to the frame, drywall, flooring, plumbing, and other components of the building. Foundation degradation can be caused by parts of the foundation sinking where the soil conditions are insufficient to support the structure. Piles may need to be lifted in order to strategically lift certain parts of the building structure. Piles may become damaged or degraded and need to be lifted to be repaired, reinforced, or replaced.

When a foundation structure sinks, it becomes necessary to raise the sinking portion and support it such that it does not re-settle or sink further. Prior techniques have involved jacking up the foundation and positioning pilings below foundation for support. However, the pilings are not in contact with the solid strata, so additional foundation sinking can still occur. Additionally, these techniques can be very expensive and can be visually unpleasing as the repair components such as the pilings are typically visible after the repair work is completed.

Moreover, sometimes a foundation needs support within the perimeter boundaries of the foundation and in an area that is not easily reached from outside the edges of the foundation. For example, with a concrete slab foundation, support is sometimes needed in an area within the slab boundaries. In certain areas such as this, supporting an edge of the foundation is not sufficient. And, reaching certain interior areas from the exterior of the structure over the foundation, or from the outer edges of the foundation, may involve extensive excavation. This may include substantial drilling and tunneling underneath the structure, from the outside or outer edges, to reach the area that needs support. This can be cost-prohibitive. Prior methods have involved a hole through the foundation, inserting a support device and raising the support device to support the slab.

SUMMARY

Certain embodiments of the invention provide an apparatus and methods for lifting a pile that is embedded in strata. In one example, an apparatus for lifting a pile is provided. The apparatus includes a support structure and a lifting device coupled to the support structure. The apparatus also includes a lift head coupled to the lifting device. The lift head has a first gripping plat. The first gripping plate is adapted to engage and support the pile upon activation of the lifting device.

In another example, a method of lifting and supporting a pile is provided. The method includes coupling a support structure to the pile and coupling a lifting device to the support structure. The method also includes extending the lifting device to cause a lift head with a first gripping plate to engage and lift the pile during extension of lifting device. The pile is lifted a first distance.

One or more of the embodiments may provide some, none, or all of certain of the following advantages. One advantage is that an apparatus is provided, which may be easily inserted into a hole in a foundation and subsequently used to lift and/or support a pile. Another advantage is that the apparatus may be used to lift a pile and automatically grab and release the pile at appropriate times during the lifting process. Another advantage is that the same apparatus may be used to both lift a pile and support the pile when it has been lifted.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Various embodiments are illustrated in FIGS. 1-7, In Summary, various embodiments provide an apparatus for lifting and/or supporting a pile, such as might be used, for example, in a foundation support structure. The apparatus may lift, a pile hydraulically and at least in certain, embodiments, incorporates a gravity-operated lifting head engage the during, lifting. The apparatus may also, in certain embodiments, incorporate a gravity-operated vice for holding the pile in place while a hydraulic mechanism is being retracted.

Figure 1:
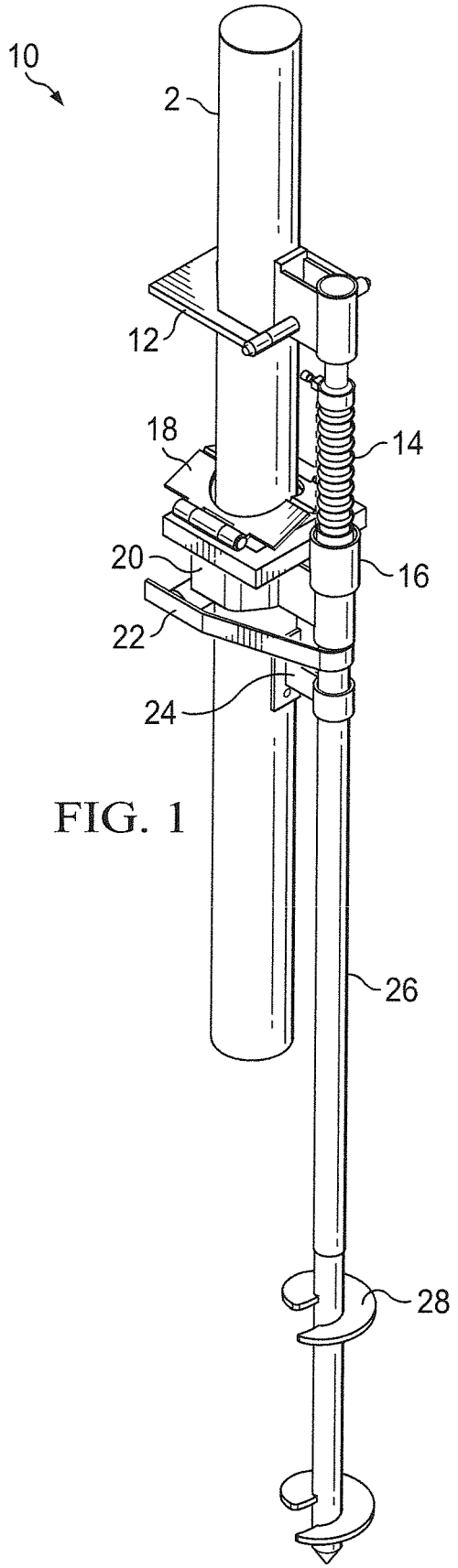
FIG. 1: is perspective view of a pile lifting apparatus: in accordance with an example embodiment.
Figure 7:
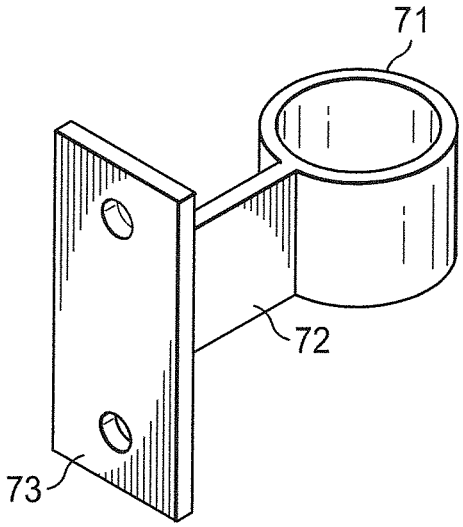
FIG. 7 is a perspective view of a lower support bracket for a pile lifting apparatus in accordance with an example embodiment.
Figure 2:
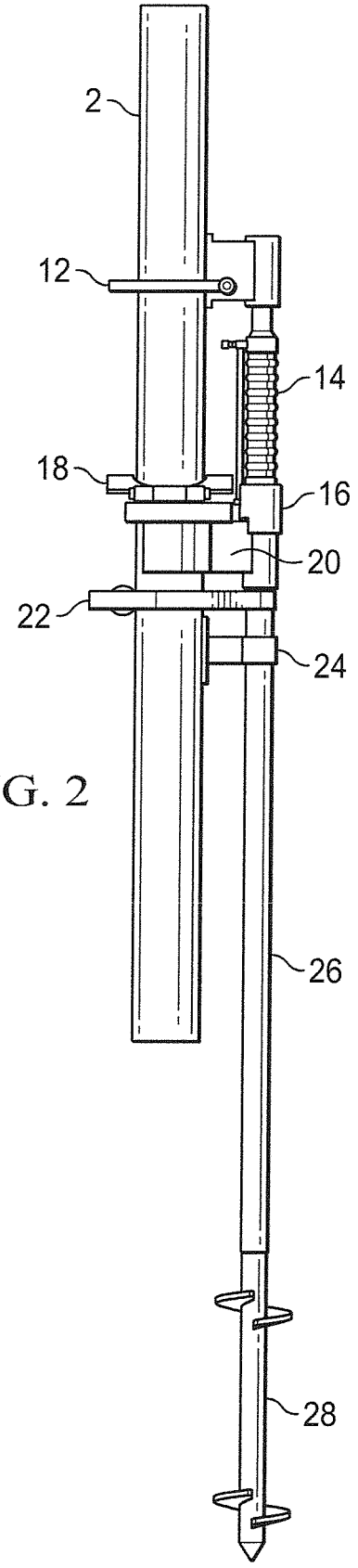
FIG. 2 is side view of the apparatus of FIG. 1.
Figure 3:
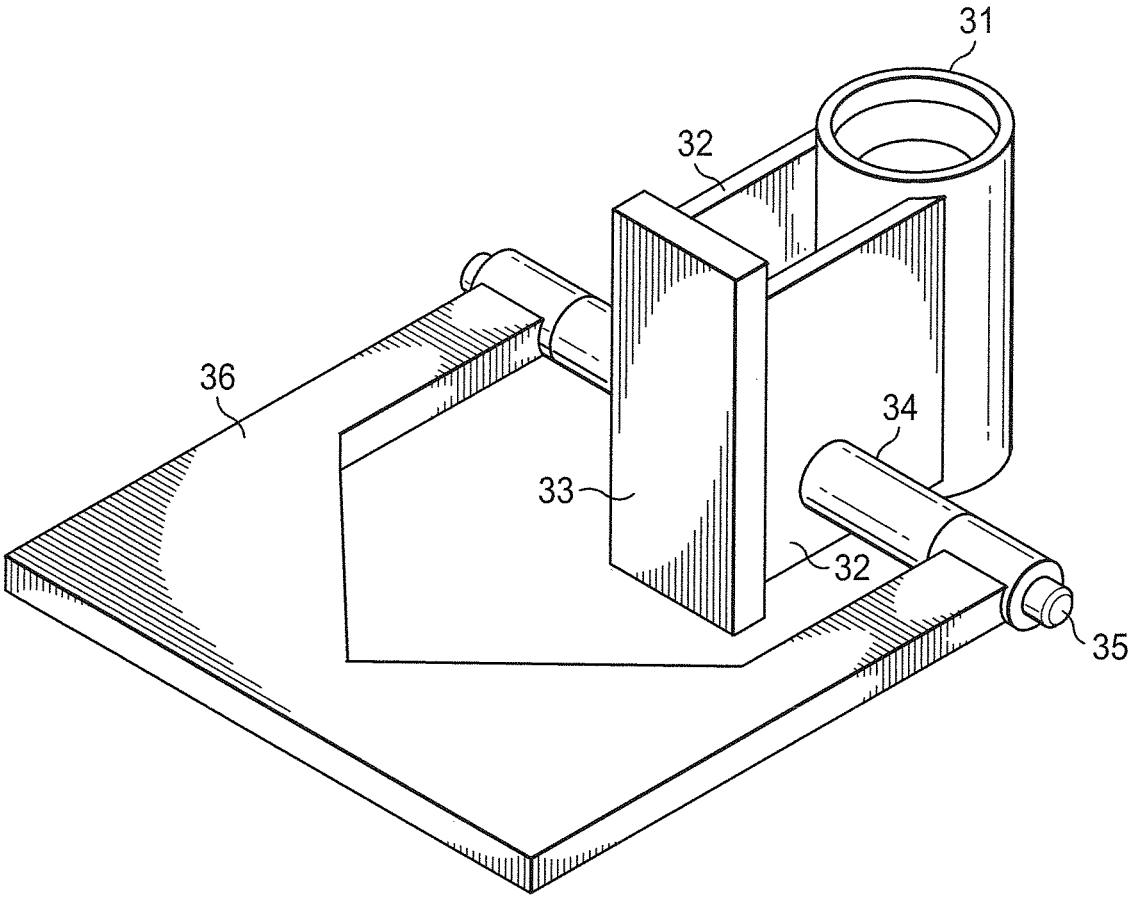
FIG. 3 is a perspective view of a lift head for a pile lifting apparatus in accordance with an example embodiment.
Figure 4:
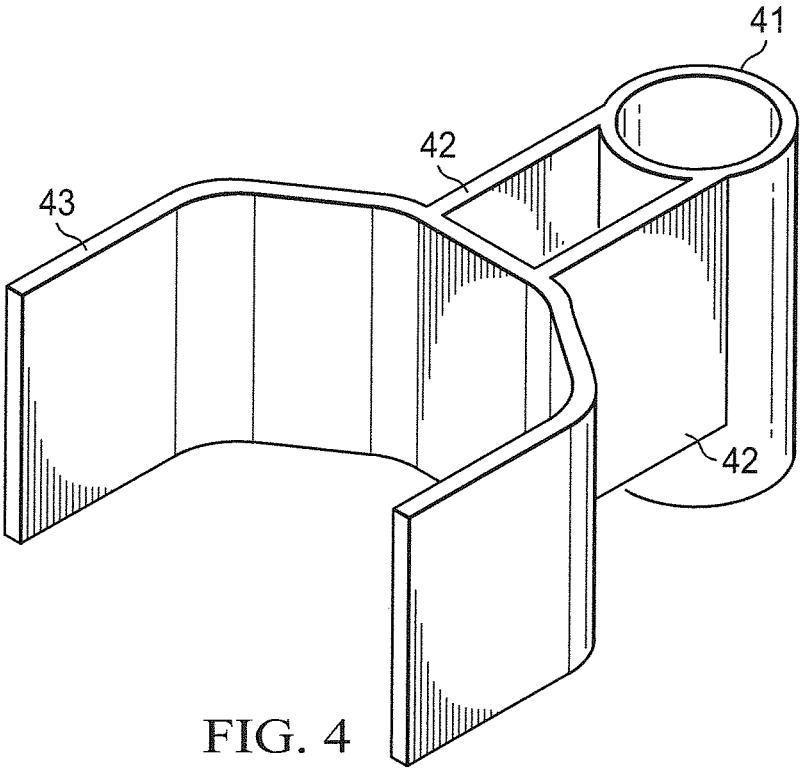
FIG. 4 is a perspective view of an upper support bracket for a pile lifting apparatus in accordance with an example embodiment.
Figure 5:
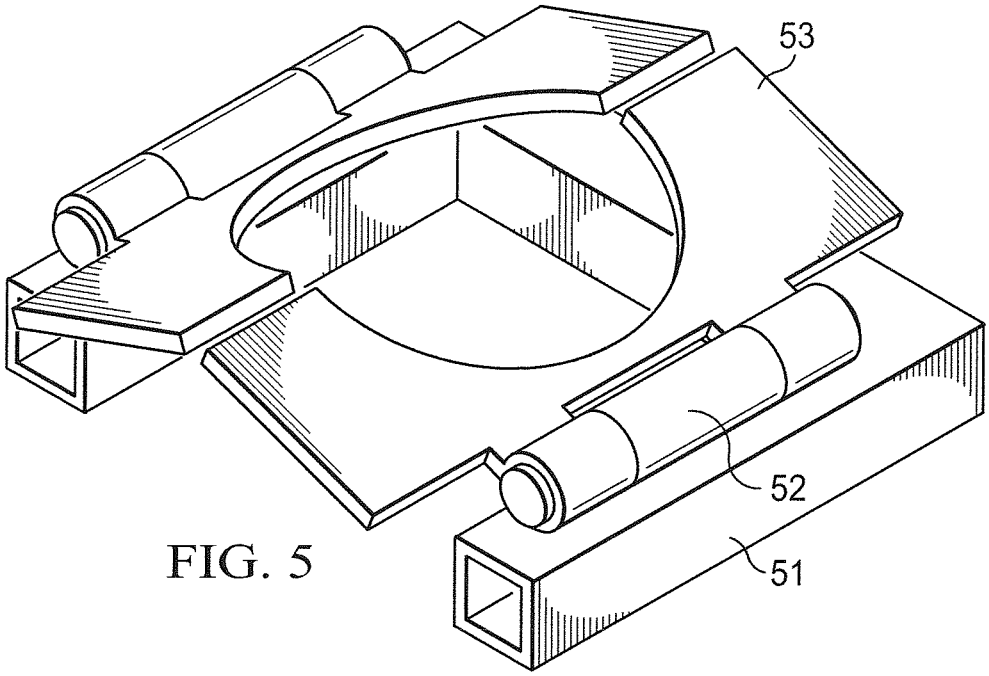
FIG. 5 is a perspective view of a gravity vice for a pile lifting apparatus in accordance with an example embodiment.
Figure 6:
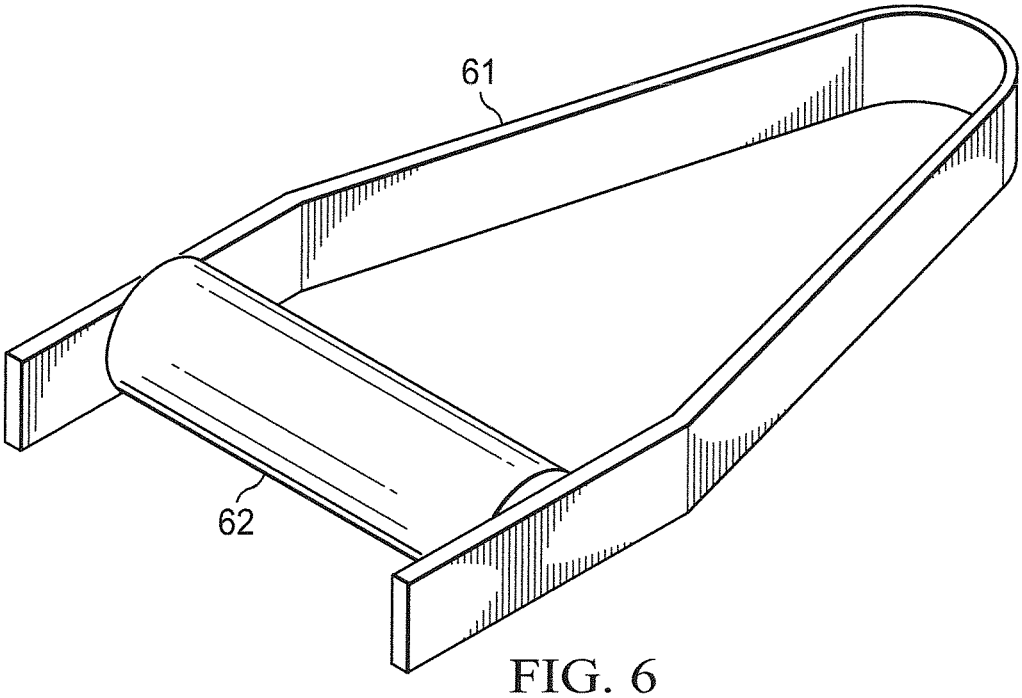
FIG. 6 is a perspective view of a support roller strap for strap pile lifting apparatus in accordance with an example embodiment.

As illustrated in FIGS. 1 and 2, a pile lifting apparatus 10 is provided for lifting and/or supporting pile 2. It should be recognized that although apparatus 10 is shown in conjunction with a pile 2, apparatus 10 may be used for lifting and/or supporting a variety of pole-type structures. Further, the various features and elements of apparatus 10 may be used in other devices where repetitive lifting is performed. Moreover, although all of the components (less pile 2) illustrated in FIGS. 1 and 2 are described as being part of apparatus 10, it should be recognized that other inventive embodiments may include fewer than all, of the components illustrated.

Apparatus 10 includes a support structure including a helical pile 28 and a pile extension (not expressly shown) coupled thereto. In FIGS. 1 and 2, the pile extension is within guide sleeve 26 and, therefore, cannot been seen. Helical pile 28 and its pile extension provide a support structure, which may be driven into strata. Preferably, helical pile 28 is driven to a depth where it contacts solid strata, or bedrock. Guide sleeve 26 both guides and supports the pile extension. While it is driven, along with helical pile 28, into the earth.

Preferably, the support structure is driven adjacent pile 2 that is to be lifted and/or supported. In some embodiments, helical pile 28 and its extension are first driven to desired depth and then coupled to pile 2. In other situations, guide sleeve 26 may be coupled to pile 2, and then helical pile 28 and its extension are driven. It should also be recognized that in certain situations a helical pile is not required. Certain aspects and functionality of the apparatus may be achieved as long as a support structure is provided adjacent pile 2, which is the pile to be lifted.

Lower support bracket 24 is coupled to guide sleeve 26 and abuts pile 2. Preferably, lower support bracket 24 abuts pile 2 to provide lateral stability to pile 2 while allowing pile 2 to be moved vertically during a lifting process. Lower support bracket 24 is illustrated in further detail in FIG. 7. Lower support bracket 2 includes a coupling cylinder 71, an extension plate 72 extending perpendicularly from the longitudinal axis or coupling cylinder 71, and a vertical support plate 73 coupled to extension plate 72. It is the vertical support Preferably, the vertical support plate has holes formed therein for allowing attachment of the plate to the pile, and thus coupling of the pile to the support structure, by way of bolts, nails, spikes, screws, or other appropriate attachment devices. In certain embodiments, lower support bracket. 24 is connected to guide sleeve 26 by sliding the coupling cylinder 71 of lower bracket 24 over and onto guide sleeve 26 such that coupling cylinder 71 surrounds an exterior surface of guide sleeve 26. In some embodiments, lower support bracket 24 is allowed to freely move up and down guide sleeve 26 (or other components of the support structure such as, example, the helical pile extension) during the lifting process. In other embodiments, during the lifting process, downward movement of lower support bracket 24 may be limited by an upper end of guide sleeve 26. This may be the case, for instance, if lower support bracket's coupling cylinder 71 has a large enough diameter to slide over the helical pile extension, but a small enough diameter to be prevented from sliding over the guide sleeve. In still other embodiments, during the lifting process, lower support bracket 24 may be temporarily attached to the support structure.

Referring further to FIGS. 1 and 2, apparatus 10 also includes a support roller strap 22. As can be seen in more detail in FIG. 6, roller strap 22 includes a strap 61 and a roller 62 coupled to strap 61. Strap 61 comprises a length of a metal plate, which is bent in a generally U-shaped configuration, such that the seat of the U shape is adapted to fit around one side of guide sleeve 26. The arms of the U, near their distal ends, are provided with inward-facing pegs or a bar extending between the arms (not expressly shown) for supporting roller 62. Roller 62 is adapted to fit next to a side of pile 2 opposite guide sleeve 26. Support roller strap 22 provides additional lateral stability to pile 2 and prevents pile 2 from moving laterally away from guide sleeve 26. Roller 62 allows pile 2 to slide upwardly within support roller strap 22 during the lifting process. Preferably, outward pressure as created on the support structure during the lifting process to prevent the support roller strap from spinning around the guide sleeve. Also, the fit of the support roller strap on both the support structure and the pile being lifted helps to prevent the support roller strap from spinning about the supports structure. These aspects also help to prevent the Support roller strap from moving downward along the support structure. Downward movement is further inhibited by the lower support bracket.

Referring again to FIGS. 1 and 2 apparatus 10 also includes an upper support bracket 20. Upper support bracket 20 is shown in greater detail in FIG. 4 and includes coupling cylinder 41, a pair of extension plates 42, and a C-shaped support plate 43. Extension plates 42 are coupled to coupling cylinder 41 and extend laterally away from coupling cylinder 41 in a direction that is perpendicular to the longitudinal axis of coupling ring 41. Distal ends of extension plates 42 are coupled to C-shaped support bracket 43. C-shaped support bracket 43 is adapted to abut and laterally support pile 2. During the lifting process, Movement of the upper support bracket along the support structure is inhibited in the same way as per the lower support bracket.

Referring again to FIGS. 1, and 2, apparatus 10 also includes a gravity vice 18. As can be in greater detail in FIG. 5, gravity vice 18 includes a U-shaped support 51 having a back section adapted to rest adjacent guide sleeve 26 and a pair of arms extending away from guide sleeve 26. Gravity vice 18 also includes a pair of hinges 52, each having a gripping plate 53 hingedly attached thereto. Preferably the free ends of gripping plates 23 are disposed in a generally upward from the arms of U-shaped support 51 such that they cannot rotate downwardly past the plane defined by U-Shaped support 51. Both of gripping plates 53 have a C-shaped cutout portion adapted to fit about an exterior surface of pile 2. When no lifting force is being applied to the 2, the weight of gripping plates 53 causes them to engage the sides of pile 2. The weight of pile 2 pushes down on the C-shaped ends of gripping plates 53 causing the ends of plates 53 to dig into the sides of pile 2, thereby preventing further downward movement of pile 2, when a lifting force is no longer being applied to pile 2. In at least some embodiments, gravity vice 18 is coupled to upper support bracket 20. This keeps gravity vice 18 in place and provides stability to gravity plate 18 during the times that pile 2 is engaging gripping plates 53. It should be noted that the cutout portions of the gripping plates may have different shapes and/or configurations.

Referring again to FIGS. 1 and 2, apparatus 10 also includes a jacking cup 16. In certain embodiments jacking cup 16 rests atop an upper end of the pile extension coupled to helical pile 28. Jacking cup 16 may have a cylindrical shape, or other shape to match the cross section of the pile extension. Jacking cup 16 may have a pair of slots extending partial along its length from the bottom. The slots are positioned to match the pair of extension plates 42 of upper support bracket 20. The slots of jacking cup 16 interfit with extension plates 42 to provide stability to the unit and to prevent jacking cup 16 and/or upper support bracket 20 from turning about guide sleeve 26 and/or the pile extension that is within guide sleeve 26 in FIGS. 1 and 2.

Jacking cup 16 preferably supports a lifting device 14. Preferably, lifting device 14 is hydraulically-actuated. The downward end of lifting device 14 buts against the upper end of the pile extension and/or guide sleeve 26. Alternatively, jacking cup 16 may be provided with an interior plate on which the lower end of lifting device 14 may rest. Preferably, when lifting device 14 is actuated, an upper end of lifting device 14 extends upwardly (i.e., away from jacking cup 16 and the upper end of the pile extension).

Apparatus 10 also includes a lift head 12, which may be coupled to an upper end of lifting device 14. As can be seen in greater detail in FIG. 3, lift head 12 includes a coupling cylinder 31, a pair of extension plates 32, and a bracket plate 33. Coupling cylinder 31 is adapted to fit on, and surround an exterior surface of, a lifting arm of lifting device 14. Extension plates 32 extend from coupling cylinder 31 in a direction away from lifting device 14 and toward pile 2 (when pile 2 is engaged by apparatus 10). Bracket plate 33 is coupled to the distal ends of extension plates 32 in a vertical manner (i.e., such that it is parallel to the longitudinal axis of the lifting arm of lifting device. Like the vertical bracket plates of the upper and lower support brackets, bracket plate 33 helps to support and laterally stabilize pile 2 when coupled to apparatus 10.

Extension plates 32 also accommodate a hinge pin support tube 34. Tube 34 is coupled to extension plates 32 in a transverse manner wherein its axis is perpendicular to the longitudinal axis of the support structure of apparatus 10, and wherein its length is disposed within a plane that is perpendicular to the support structure of apparatus 10.

Tube 34 supports hinge pin 35, which is disposed through tube 34. In the illustrated example, tube 34 may be a single tube that is disposed through holes in extension plates 32. Likewise, hinge pin 35 is a single pin disposed though tube 34. Alternatively, tube 34 may comprise two or more smaller tubes. For example, a smaller tube may extend outwardly from each extension plate. Also, another smaller tube may be provided between the extension plates. Preferably, in this alternative embodiment, the tubes would axially align with holes in the extension plates. In another example, a tube extends outwardly from each of the extension plates. A small hinge pin is disposed within each of the small tubes (i.e., there are two hinge pins). Any suitable alternative is viable as long as one or more hinge pins is provided and supported to allow swinging movement of an associated lift head plate, as described below.

Lift head plate 36 is hingedly connected to hinge pin 34 to allow for up and down swinging movement of a distal end of lift head plate 36. Lift head plate 36 Preferably has a cutout portion at a distal end thereof. In the illustrated example, the cutout portion is V-shaped. However, other shapes may be employed. The cutout portion provides a plurality of gripping edges for gripping pile 2 when engaged by apparatus 10. Lift head plate 36 is adapted to grip pile 2 during a lifting process. As pile 2 is lifted, the distal end of lift head plate 36 falls downward due to gravity. Downward movement of lift head plate 36 is limited by contact with pile 2. With continued lifting, the gripping edges of the cutout portion of lift head plate 36 are adapted to dig into the surface of pile 2 to impart upward movement of pile 2 while lift head 12 is being raised.

Figure 8:
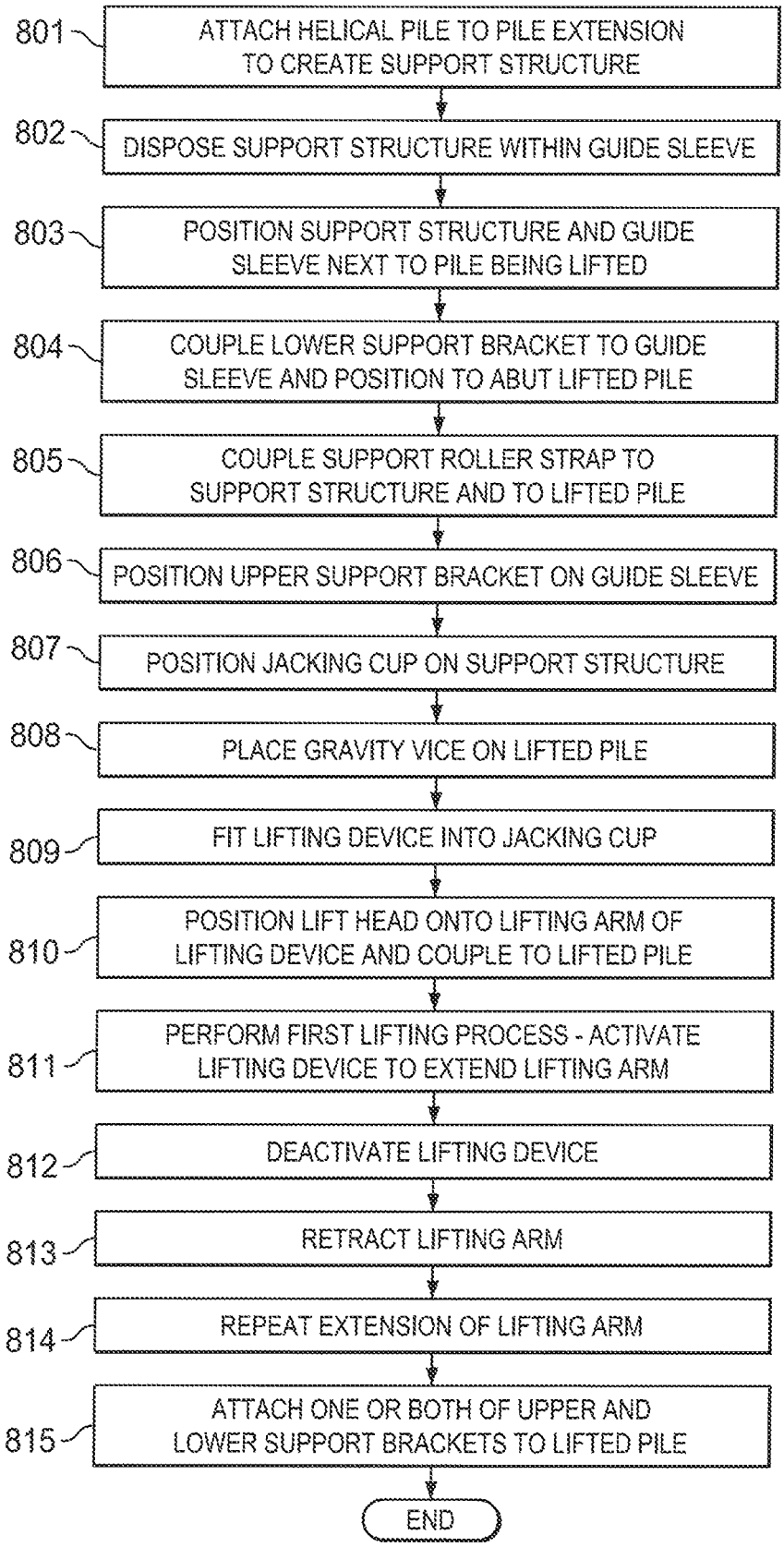
FIG. 8 is a flow chart illustrating a method of filing at pile in accordance with and example embodiment.

A method 800 for lifting a pile (e.g., pile 2) will now be described in connection with the flow chart provided in FIG. 8. It should be understood that various embodiments may add steps, eliminate steps, modify steps, and/or reorder steps.

In one step 801, a helical pile is attached to a pile extension to create a support structure.

In another step 802, the support structure is at least partially disposed in a guide sleeve.

In another step 803, the support structure and guide sleeve are positioned next to a pile needing lifting and/or support, and the support structure is driven into the strata. Preferably, the support structure is driven downwardly until the helical pile contacts bedrock or stable strata capable of supporting the structure, or foundation of the structure, associated with the pile.

In another step 804, a lower support bracket is coupled to the guide sleeve and positioned, to abut the pile being lifted.

In another step 805, a support roller strap is coupled to or positioned on, the guide sleeve and positioned so that the pile being lifted is disposed in the gap created by the roller and the strap of the support roller strap. In some cases, the support roller strap may be lowered onto the pile and then onto the guide sleeve. In other cases, the strap of the support roller strap may be positioned on the guide sleeve. Then the roller of the support roller strap may be attached to the strap to encompass the pile.

In another step 806, an upper support bracket is positioned on the guide sleeve. In at least certain embodiments, the support roller strap is disposed between the lower support bracket and the upper support bracket.

In another step 807, a jacking cup is placed atop the guide sleeve and/or the support structure.

In another step 808, a gravity vice is place on the pile being lifted, such that pile is disposed within a void between the cutout portions of the gripping plates of the gravity vice.

In another step 809, a lifting device is fitted into the jacking cup.

In another step 810, a lift head is positioned on a lifting arm of the lifting device such that the lift head plate of the lift head surrounds the pile.

In another step 811, a first lifting process is performed. According to this process, the lifting device is activated to extend the lifting arm. As the lifting arm extends, it pushes the lift head upward. Gravity causes the distal end of the lift head plate to drop downwardly with respect to the level of the other components of the lift head. The downward swinging movement is stopped when the gripping edges of the lift head plate engage the surface of the pile being lifted. As the lifting arm continues to extend, the gripping edges of the lift head plate dig into the surface of the pile being lifted. This imparts a lifting force to the pile and the pile is lifted along with the lift head.

It should be understood that activation of the lifting device with the resulting extension of the arm of the lifting device is an example only. Other lifting devices may be incorporated. Activation of the lifting device is intended to convey that state of the lifting device which performs lifting.

In another step 812, the lifting device is deactivated such that extension of the lifting arm is halted. Preferably, extension of the lifting arm is halted at a predetermined distance corresponding to the maximum extension range of the lifting arm.

In another step 813, the lifting arm is retracted. This causes the lift head to begin to be lowered. As the lift head is lowered, the gripping edges of the lift head plate release from the surface of the pile and gravity causes the pile to tend move downwardly. However, as the pile begins its downward movement, the gripping plates of the gravity device engage the surface of the pile. The edges of the cutout portions of the gripping plates of the gravity vice dig into the surface of the pile and halt downward movement of the pile due to gravity. The lifting arm of the lifting device may thus be fully retracted while the pile is supported in its partially lifted position by the gravity vice.

In another step 814, the lifting arm is again extended. The lift head engages the pile and begins to lift the pile upwardly. The upward movement of the pile causes the gripping to swing upwardly and release from the surface of the pile. The lifting and retracting steps are alternately repeated until the pile has been lifted to a desired height.

In another step 815, one or more of the lower support bracket and upper support bracket may be attached to the pile that has been lifted. This allows removal of the remaining components of the lifting apparatus while the pile remains supported in its lifted position.

What is claimed is:

1. A method of lifting and supporting a pile, comprising:

coupling a lifting device to a support structure, said lifting device having a lift head coupled to an upper end of said lifting device, said lifting device having a gripping plate hingedly connected to said lift head such that said gripping plate is capable of swinging up and down, said gripping plate and said lift head define an opening adapted to engage and impart upward movement to a pile, coupling the support structure to the pile such that said pile passes through said opening defined by said lift head and said gripping plate, allowing said gripping plate to swing downward and contact said pile, extending the lifting device to cause said first gripping plate to engage and impart upward movement to said pile thereby lifting the pile during extension of lifting device, the pile being lifted a first distance, and retracting the lifting device and supporting the pile with a gravity vice during retraction of the lifting device.

2. The method of claim 1, wherein the gravity vice has a first plate adapted to engage the pile during retraction of lifting device.

3. The method of claim 1, further comprising extending the lifting device to disengage the gravity vice from the pile and to cause the lift head to engage the pile to lift the pile a second distance.

4. The method of claim 1, further comprising alternating additional extension and retraction of the lifting device to alternately lift and support the pile to lift the pile in steps to a desired height.

5. An apparatus for lifting a pile, the apparatus comprising:

a support structure, a lifting device coupled to the support structure, and a lift head coupled to the lifting device, the lift head having a first gripping plate, the first gripping plate adapted to engage and support the pile upon activation of the lifting device, a gravity vice coupled to the support structure, the gravity vice being adapted to engage and support the pile upon deactivation of the lifting device, a support roller strap coupled to the support structure, the support roller strap adapted to surround and laterally support the pile during lifting.

6. The apparatus of claim 5, wherein the first gripping plate is configured to engage the pile upon activation of the lifting device and is configured to disengage from the pile upon deactivation of the lifting device.

7. The apparatus of claim 5, wherein the lifting device is adapted to extend to lift the pile, and wherein the first gripping plate is configured to engage the pile upon extension of the lifting device, and is configured to disengage from the pile upon retraction of the lifting device.

8. The apparatus of claim 5, wherein the lifting device has an arm, and wherein the first gripping plate is configured to engage the pile upon extension of the arm and is configured to disengage from the pile upon retraction of the arm.

9. The apparatus of claim 5, wherein the lifting device has an arm that extends and retracts, the gravity vice being adapted to engage the pile upon retraction of the arm and disengage from the pile upon extension of the arm.

10. A method of lifting and supporting a pile, comprising:

coupling a support structure to the pile, coupling a lifting device to the support structure placing a support roller strap around the pile, and extending the lifting device to cause a lift head with a first gripping plate to engage and lift the pile during extension of the lifting device, the pile being lifted a first distance, during lifting laterally supporting the pile with the support roller strap, and retracting the lifting device and supporting the pile with a gravity vice during retraction of the lifting device.

11. The method of claim 10, further comprising extending the lifting device to disengage the gravity vice from the pile and to cause the lift head to engage the pile to lift the pile a second distance.

12. The method of claim 10, further comprising alternating additional extension and retraction of the lifting device to alternately lift and support the pile to lift the pile in steps to a desired height.

13. An apparatus for lifting a pile, the apparatus comprising:

a support structure, a lifting device coupled to the support structure, and a lift head coupled to an upper end of the lifting device, the lift head having a first gripping plate, the first gripping plate adapted to engage and impart upward movement to the pile upon activation of the lifting device; and, a support roller strap coupled to the support structure, the support roller strap adapted to surround and laterally support the pile during lifting.

14. The apparatus of claim 13, further comprising a second gripping plate, the first and second gripping plates being opposed to one another and adapted to cooperatively engage the pile between respective ends of the first and second gripping plates upon activation of the lifting device.

15. The apparatus of claim 13, further comprising a gravity vice coupled to the support structure, the gravity vice being adapted to engage and support the pile upon deactivation of the lifting device.

16. The apparatus of claim 15, wherein the lifting device extends and retracts, the gravity vice being adapted to engage the pile upon retraction of the lifting device and disengage from the pile upon extension of the lifting device.

17. An apparatus for lifting a pile, the apparatus comprising:

a support structure, a lifting device coupled to the support structure, and a lift head coupled to an upper end of the lifting device, the lift head having a first gripping plate hingedly connected to said lift head such that said gripping plate is capable of swinging up and down, said gripping plate and said lift head define an opening suitable for receiving said pile, the first gripping plate adapted to engage and impart upward movement to the pile upon activation of the lifting device;

a gravity vice coupled to the support structure, the gravity vice being adapted to engage and support the pile upon deactivation of the lifting device, and, wherein the lifting device has an arm, and wherein the first gripping plate is configured to engage the pile upon extension of the arm and is configured to disengage from the pile upon retraction of the arm.

18. The apparatus of claim 17, further comprising a second gripping plate, the first and second gripping plates being opposed to one another and adapted to cooperatively engage the pile between respective ends of the first and second gripping plates upon activation of the lifting device.

19. The apparatus of claim 17, wherein the gravity vice being adapted to engage the pile upon retraction of the arm of the lifting device and disengage from the pile upon extension of the arm.

* * * * *